US005288138A

United States Patent [19]

Stulik et al.

[11] Patent Number: 5,288,138

[45] Date of Patent: Feb. 22, 1994

[54] RECLINING CHAIR

[76] Inventors: Edward L. Stulik, 7500 Hill Rd., Roseville, Calif. 95678; Bruce Burness, 1260 Yocum St., Pasadena, Calif. 91103

[21] Appl. No.: 954,583

[22] Filed: Sep. 30, 1992

Related U.S. Application Data

[63] Continuation of Ser. No. 565,791, Aug. 10, 1990, abandoned.

[51] Int. Cl.[5] ..... A47C 3/00

[52] U.S. Cl. ..... 297/301; 297/304; 297/354.12

[58] Field of Search ..... 297/301, 353, 354, 355, 297/341, 300, 304

[56] References Cited

U.S. PATENT DOCUMENTS

| | | | |
|---|---|---|---|
| 2,272,980 | 2/1942 | McLellan et al. | 297/304 X |
| 4,372,609 | 2/1983 | Boisset | 297/355 X |
| 4,529,247 | 7/1985 | Stumpf et al. | 297/301 |
| 4,650,248 | 3/1987 | Borsani | 297/301 X |
| 4,682,814 | 7/1987 | Hansen | 297/301 X |
| 4,684,173 | 8/1987 | Locher | 297/301 X |
| 4,889,385 | 12/1989 | Chadwick et al. | 297/301 X |
| 4,892,354 | 1/1990 | Estkowski et al. | 297/301 |
| 4,962,962 | 10/1990 | Machate et al. | 297/301 X |

*Primary Examiner*—Peter A. Aschenbrenner
*Attorney, Agent, or Firm*—Koda and Androlia

[57] ABSTRACT

A reclining chair including a seat, a back and a base. The forward portion of the seat is pivotally coupled to the base such that the seat pivotally moves substantially about a knee of a person seated in the reclining chair. Also, the seat and back are coupled together such that the back portion pivotally moves substantially about a hip of the person seated in the reclining chair as the chair is reclined.

4 Claims, 6 Drawing Sheets

RECLINING CHAIR

This is a continuation of application Ser. No. 565,791, filed Aug. 10, 1990, now abandoned.

BACKGROUND OF THE INVENTION

1. Field of the Invention

This invention relates to chairs and more particularly to reclining chairs.

2. Prior Art

In the prior art there exists several different types of reclining chairs. All of these reclining chairs essentially perform the same basic function, that is the function of reclining; however, these prior art reclining chairs all have certain deficiencies.

In particular, when the chairs recline, the feet of the person seated in the chair generally rises off of the floor as the front portion of the chair rises. Such a condition is particularly undesirable in reclining chairs utilized in offices. Next, when the chair is reclined or returned to the upright position, the backrest may move up or down relative to the seat of the chair. Such a motion has the undesirable side effect of pulling out one's shirt or blouse or scrunching up one's clothes. In either event, the feeling is unpleasant and results in a disheveled appearance for the person seated in the chair when he returns to the unreclined position. In addition, the reclining mechanism is usually provided with a spring which can be adjusted to provide a preloaded biasing force against the reclining motion of the chair so that the chair does not just fall backwards; however, the spring merely provides this preload and does not compensate for the increased forces caused by the change in leverage as the chair reclines and the differences in weights of individuals seated in the chair. As a result, chairs which are designed for people who are heavy, cannot be utilized by people who are light in weight and vice versa.

Examples of prior art reclining chairs which possess one or more of the above disadvantages and which may have attempted to solve some of the above described disadvantages are described in the issued United States patents as follows:

| | |
|---|---|
| 910,357 | 2,479,175 |
| 2,611,420 | 2,925,122 |
| 3,856,346 | 4,372,608 |
| 4,386,805 | 4,402,546 |
| 4,529,247 | |

SUMMARY OF THE INVENTION

It is a general object of the present invention to solve the disadvantages described above.

In particular, it is a specific object of the present invention to provide a reclining chair which does not raise the feet of the person seated in the chair as it reclines, has a seat back which reclines with motion which does not cause discomfort to the person seated in the chair and is capable of being utilized by persons who are heavy and persons who are light.

It is still another object of the present invention to provide a reclining chair which includes a mechanism which is relatively simple and inexpensive to mass produce.

In keeping with the principles and objects of the present invention, the objects of the invention are accomplished by a unique reclining chair including a seat portion, a back portion and a base portion. The reclining chair further includes a first means for pivotally coupling together the forward portion of the seat portion to the base portion such that the seat portion pivotally moves substantially about a knee of a person seated in the reclining chair, a second means for coupling the seat and back portions together such that the back portion pivotally moves substantially about a hip of the person seated in the reclining chair and a spring means for biasing the first and second means. With this structure, the seat portion rotates about the knee of the person seated in the chair while the back portion rotates about the hip portion as the chair is reclined. In this way, the most natural and comfortable reclining motion for a chair can be achieved. The spring means can further include a mechanism which allows the spring to be utilized in a single chair in which may be seated a heavy person or a light person.

BRIEF DESCRIPTION OF THE DRAWINGS

The above mentioned feature and objects of the present invention will become more apparent with reference to the following description taken in conjunction with the accompanying drawings wherein like reference numerals denote like elements and in which.

DETAILED DESCRIPTION OF THE INVENTION

Figure 1:
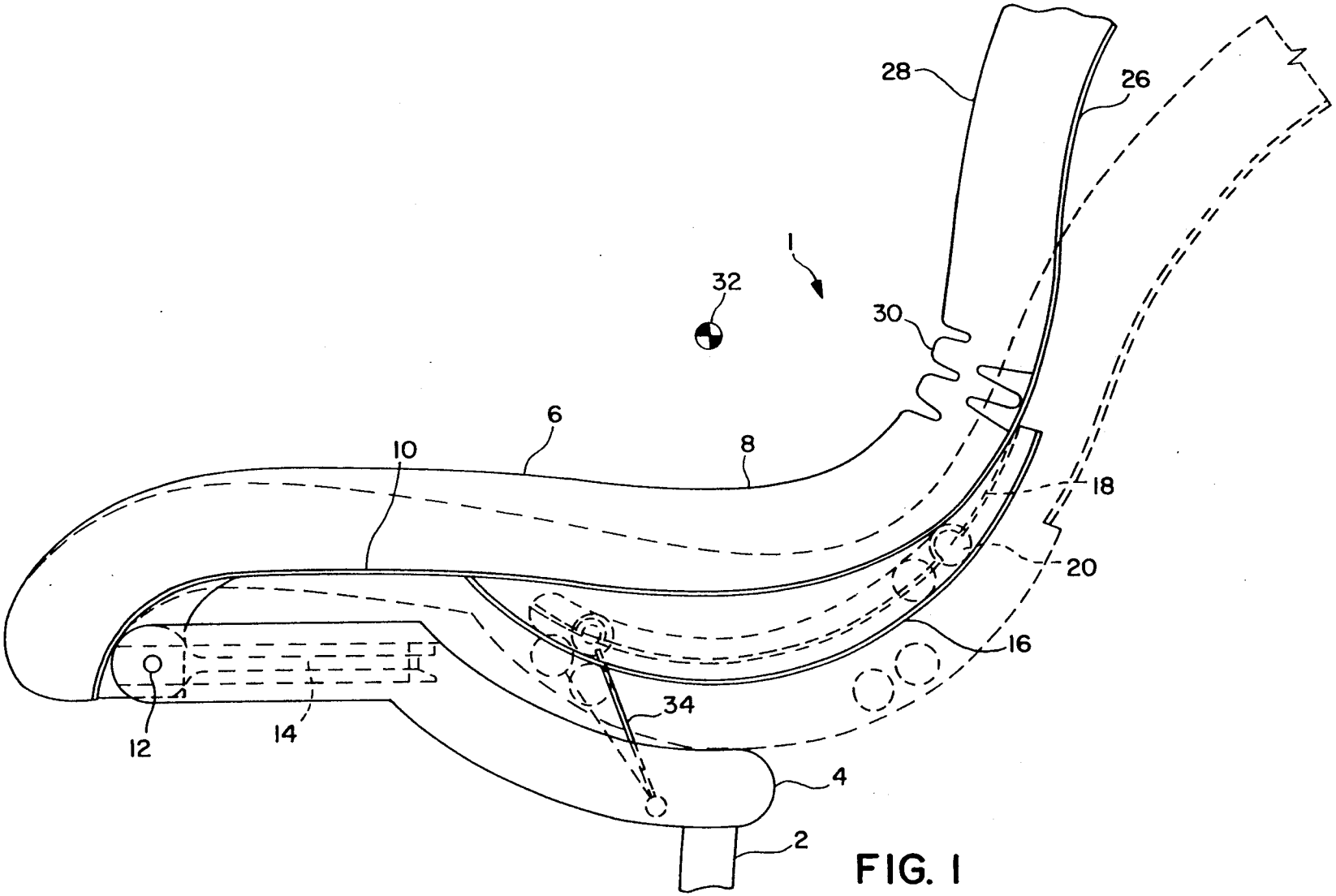
FIG. 1 is a side view of a first embodiment of a reclining chair in accordance with the teachings of the present invention.
Figure 2:
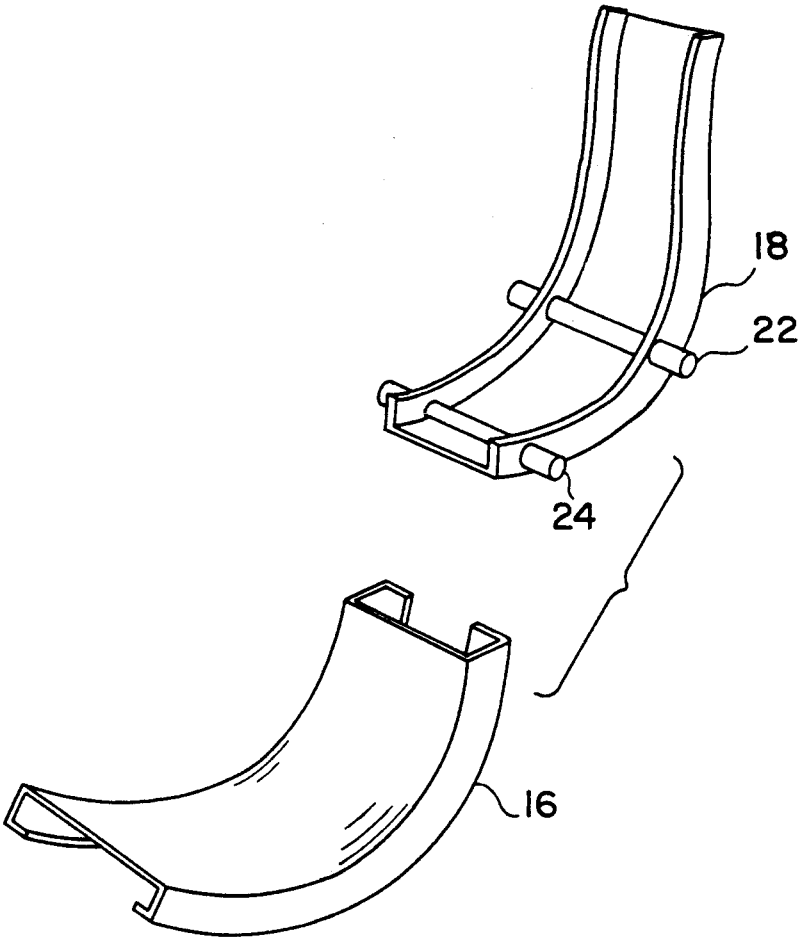
FIG. 2 is a perspective view of the slider mechanism utilized in the reclining chair of FIG. 1.

Referring to FIGS. 1 and 2, shown therein is the first embodiment of a reclining chair in accordance with the teachings of the present invention. This first embodiment of the reclining chair includes a base 2 and a lower support 4 which is rotatably coupled to the base 2. The lower support 4 essentially rotates about the base 2 in a horizontal plane. The seat 6 of the reclining chair 1 comprises a cushion 8 which is affixed to a seat pan 10. The seat pan 10 is pivotally coupled at a point adjacent to the front portion of the seat pan 10 to the distal end of the lower support 4 by a shaft 12. The shaft 12 defines a pivot point which is in parallel with a knee 15 of a person seated in the, reclining chair 1. Further coupled to the seat pan 10 is a leaf spring 14. The leaf spring 14 is coupled at one end to the seat pan 10 and at the other end to the lower support 4. In this way, the leaf spring 14 can bias the seat against the reclining motion.

Coupled to the underside of the seat pan 10 is a lower guide 16. An upper guide 18 is inserted within the lower guide 16. Also, roller wheels 20 are provided on the shafts 22 and 24 of the upper guide 18 and the roller wheels 20 roll within the lower guide 16 and reduce the friction of motion between the upper guide 18 and the lower guide 16 as the chair is reclined.

To the upper guide 18 is provided a seat back pan 26 and upon the back pan 26 is provided a back cushion 28. The back cushion 28 and the seat cushion 8 are coupled together by means of a flexible portion 30. Furthermore, the upper and lower guides 16 and 18 are curved and are provided such that as the seat 1 is reclined, the seat back pan 26 together with the seat back cushion 28 rotate about the hip 32 of a person seated in the reclining chair 1. Furthermore, provided between the lower support 4 and the shaft 24 is a link 34. This link 34 is pivotally coupled at both ends.

Figure 4A:
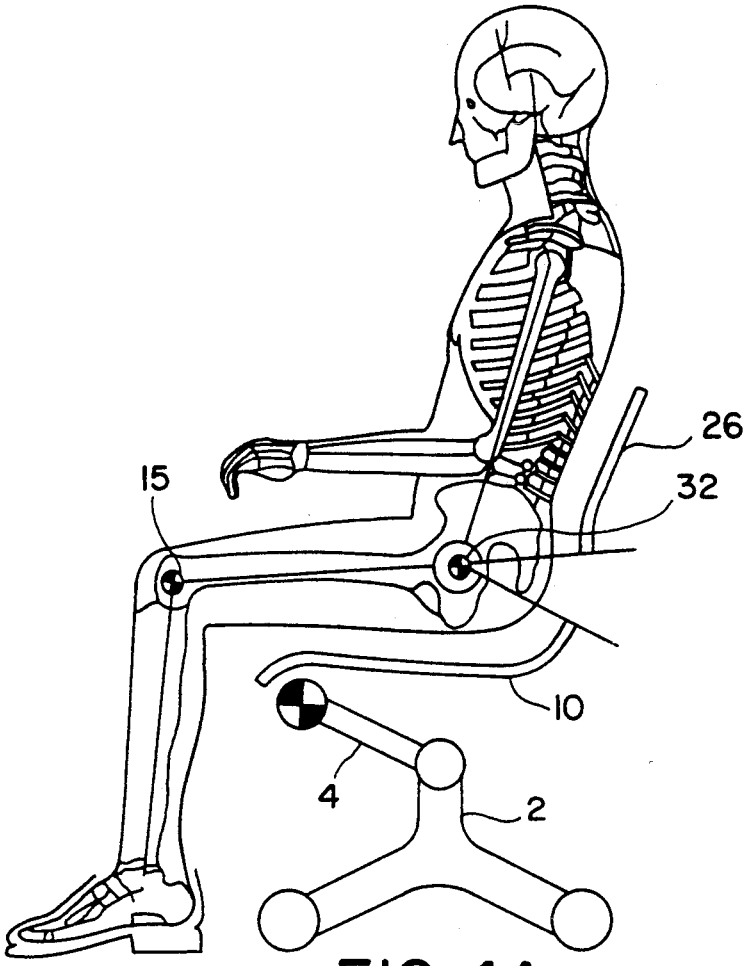
FIGS. 4A and 4B are simplified views illustrating the reclining motion of the present invention.
Figure 4B:
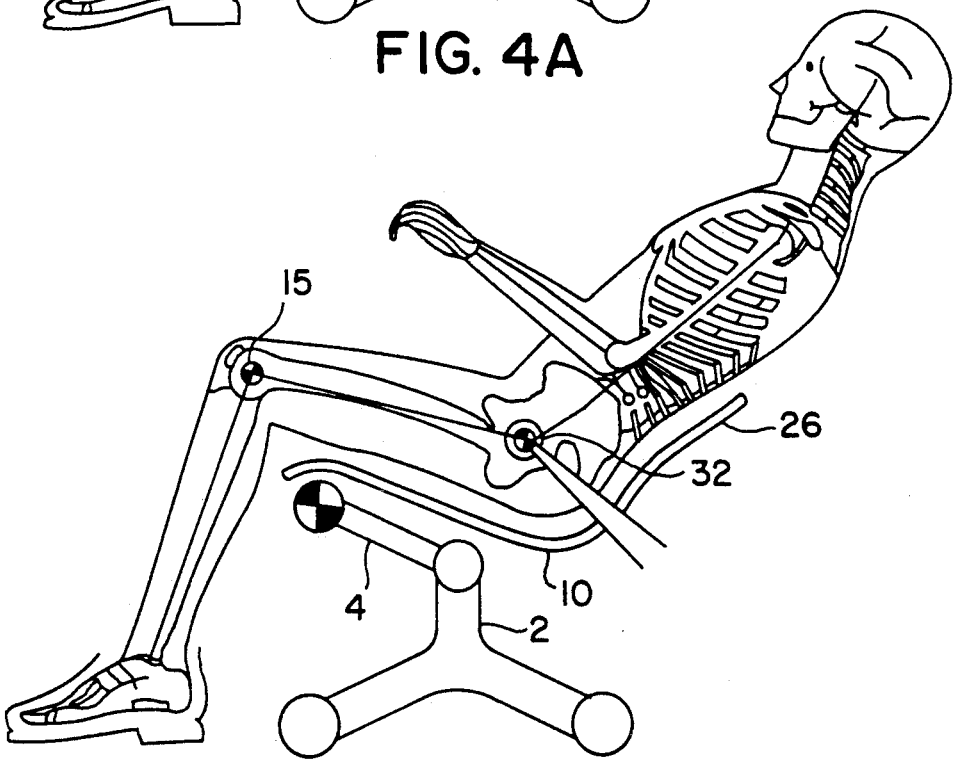

In operation, a person first sits in the reclining chair 1 as is illustrated in FIG. 4A. When the person seated in the reclining chair 1 reclines backwards, seat pan 10 first rotates about the shaft 12 which is in parallel with, the knee 15. As the seat pan 10 rotates downwardly, the leaf spring 14 is bent to provide a force against the downward rotation of the seat pan 10, the upper guide 18 is pushed into the lower guide 16 by the link 34, and the seat back pan 26 rotates about the hip 32 in a reclining direction until the seat pan 10, link 34, upper guide 18, seat back pan 26 and seat back cushion 28 reach the position shown by the dotted lines in FIG. 1. In addition, FIG. 4B shows a person seated in the reclining chair 1 in the completely reclined position. As can be seen in FIG. 4B, the reclining chair 1 has exhibited motion about two different points, the knee 15 and the hip 32, so that the person seated in the reclining chair 1 can recline without discomfort and while maintaining his or her feet on the floor.

To return to the position shown in FIG. 4A, the person seated in the chair merely leans forward and the force of the torsion spring 14 will return the reclining chair 1 to the position indicated by the solid lines in FIG. 1.

Figure 3:
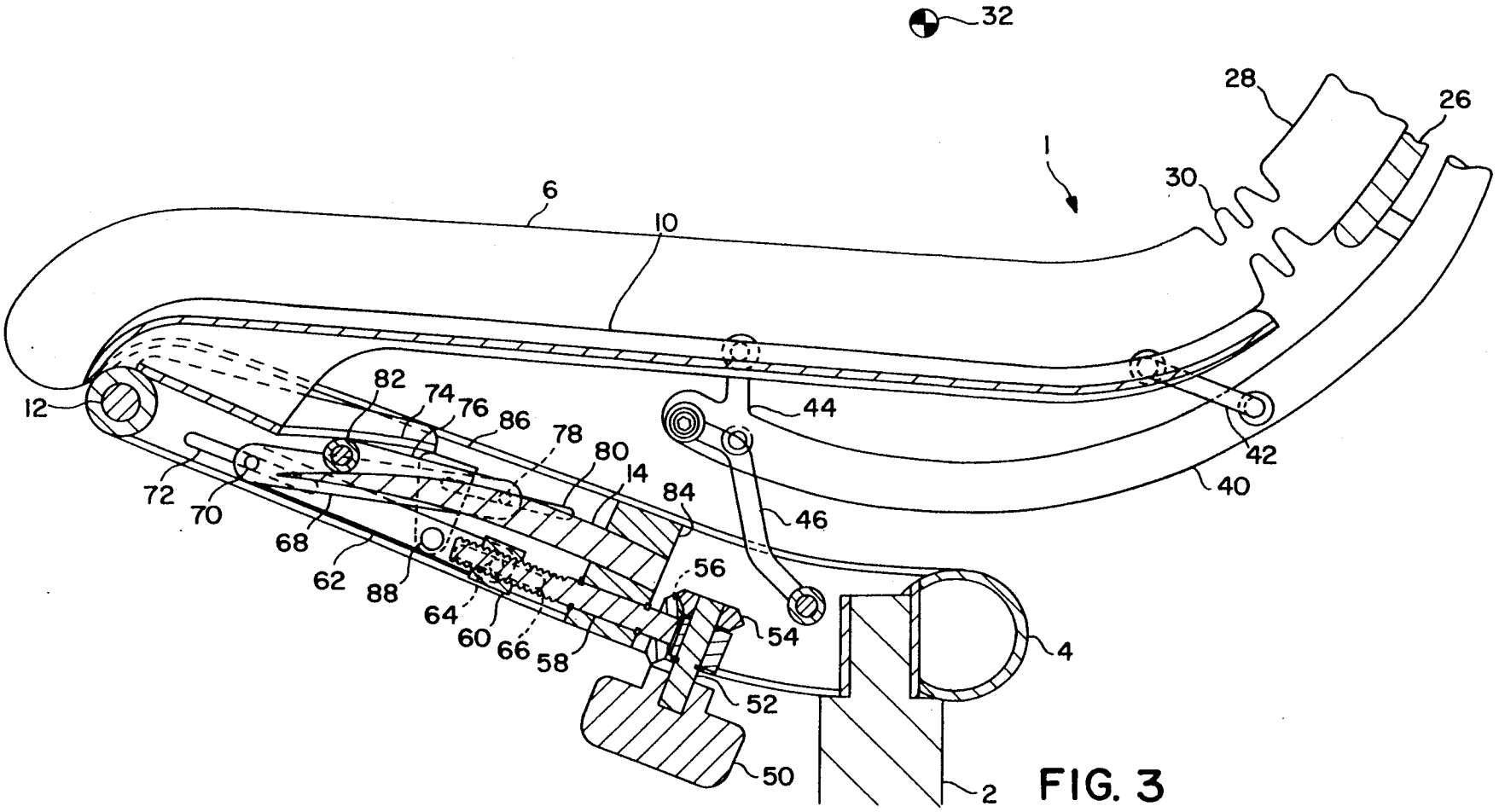
FIG. 3 is a side view in partial section of a second embodiment of a reclining chair in accordance with the teachings of the present invention.
Figure 5:
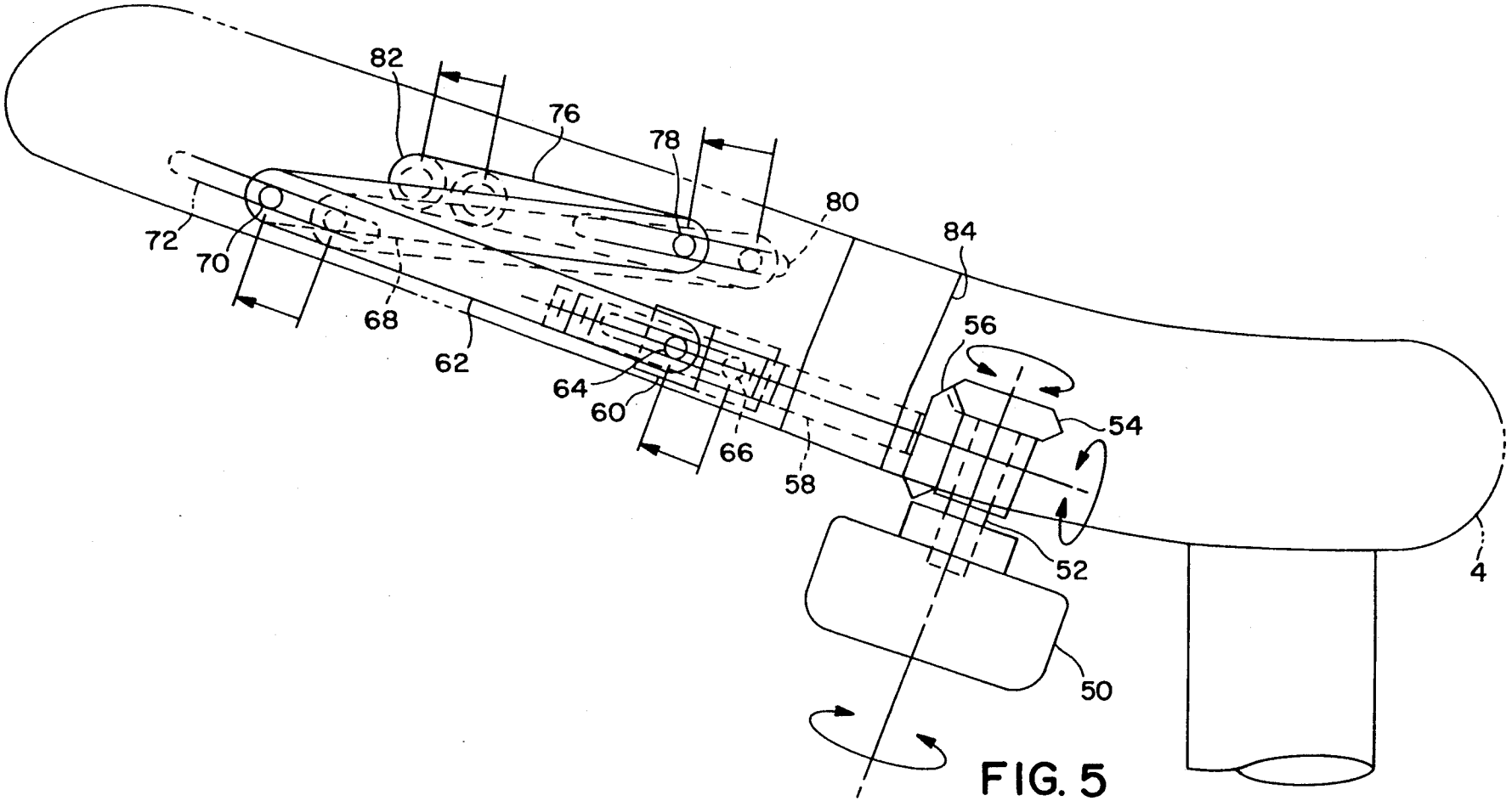
FIG. 5 is a simplified view of the seat force adjustment structure of the present invention.
Figure 6:
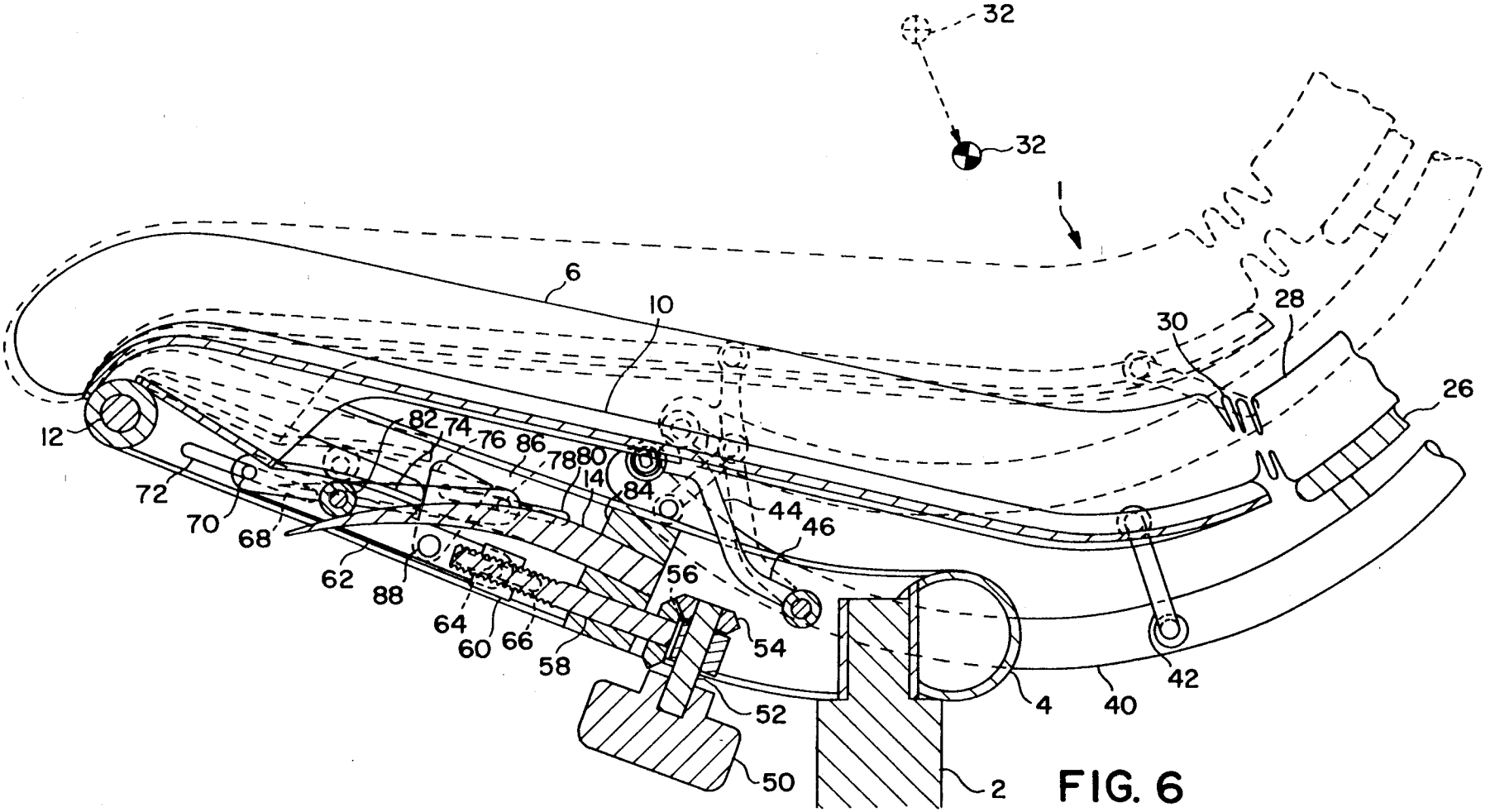
FIG. 6 is an illustration similar to FIG. 3 showing the articulation of the chair and the deflection of the spring.

Referring to FIGS. 3, 5 and 6 shown therein is a second embodiment of a reclining chair 1 in accordance with the teachings of the present invention. In this second embodiment, like elements are given like reference numerals to those in FIG. 1 and a description of there interconnection and operation will be omitted.

The reclining chair of FIGS. 3, 5 and 6 further includes an intermediate curved link 40. The curved link 40 is pivotally coupled to the seat pan 10 by an upper link 42 and a lower link 44. The lower end of the curved link 40 is pivotally coupled to the lower support 4' by an L-shaped link 46. The intermediate curved link 40 is also fixedly connected to the seat back pan 26 at at least one point.

The mechanism comprising the intermediate link 40, the straight links 42 and 44 and the L-shaped link 46 comprise the mechanism to cause the seat back pan 26 and the seat back cushion 28 to recline or pivot about the hip 32 as the seat pan 10 is downwardly pivoted about the shaft 12. Accordingly, the shapes and lengths of the links 40–46 are selected such that the intermediate curved link 40 rotates about a constant radius centered at the hip 32.

In addition, the leaf spring '14 is further provided with a mechanism for adjusting the biasing force applied to the seat pan 10 and ultimately to the person seated in the reclining chair 1 through the range of the reclining movement. This mechanism for a adjusting the biasing force is an adjustable rising rate mechanism. This mechanism comprises a knob 50 connected to a shaft 52 which drives a beveled gear 54. Further required is a beveled gear 56 engaged with the beveled gear 54 and connected to a threaded shaft 58. Threaded onto the threaded shaft 58 is a cylindrical nut 60. The cylindrical nut 60 is connected to a first link 62 by means of a shaft 64 which extends into an elongated cutout 66 in lower support 4'. The other end of the first link 62 is connected to a second link 68 by means of a shaft 70 extending through an elongated slot 72 in the lower support 4'. A swing arm 74 is connected to the seat pan 10 and the second link 68 is coupled to a third link 76 by means of a shaft 78 extending through an elongated slot 80 in the lower support 4'. Provided at the distal end of the third link 76 is a roller 82 which is further provided between the swing arm 74 and the torsion spring 14' which is fixed to the lower support 4 by a block 84.

In operation, to recline the seat from the position shown in FIG. 4A to the position shown in FIG. 4B, the seat pan 10 is pivoted about the shaft 12 to rotate the seat pan 10 about an axis which is parallel to the knee 15. At the same time and as shown in FIG. 6, the intermediate curved link 40 is pulled and guided by the links 42 through 46 to cause the seat back pan 26 to pivot about a radius centered at the hip 32 and the leaf spring 14' is deflected by the roller 82.

In addition, the force per unit distance that the chair is reclined may be varied by rotating the knob 50 clockwise or counter clockwise. As shown in FIG. 5, this rotation via the first, second and third links 62, 68 and 76 causes the roller 82 to move up and down between the swing arm 74 and the leaf spring 14'. In this way, the chair can be adjusted to be comfortable for lightweight people and for heavyweight people.

In addition to the above, the chair may further be provided with a stop 86 which is rotatably coupled to the lower support 4' at pivot 88. The stop 86 in the FIG. 3 is shown in the locked position. In this position, the stop 86 prevents the swing arm 74 from being rotated downwardly and therefore prevents the entire chair from reclining. By rotating the stop 86 in the clockwise direction, it is disengaged from the swing arm 74 and the reclining movement of the reclining chair 1 is allowed.

It should be apparent that with the reclining chair shown and described in the first and second embodiments, by locating the seat reclined pivot point at the extreme front edge of the chair seat cushion, an occupant can lean backward and then return to a normal horizontal position while keeping both feet comfortably on the floor. Furthermore, by keeping the seat reclined pivot point closest to the users knee joint, the more successfully the reclining chair can shadow the natural motion of the upper leg and thigh region. Furthermore, as the person seated in the reclining chair travels from a more horizontal position to a relaxing body reclined position, the forward pivot keeps the seat cushion surface in proper relation to the flesh of the underside of the thigh area. This means a more even pressure distribution and insures proper blood flow circulation in this critical fleshy high stress area.

Furthermore, with the reclining chair described above motions which rotate about the hip joint rather than the spine and which are natural and relaxing are provided. Furthermore, the geometry of the reclining chair causes reclining motion of the seat back structure in a trajectory about the seated occupant's hip joint and the seat pan an seat back move in synchronized motions through the reclining range so that the seat back can move without any shearing motion. As a result, there are no forces to cause the seat back to produce uncomfortable and abrasive motions against the skin and also allows reclining without having the upholstery of the reclining chair climb up against the back or pull out the shirt or blouse tail of the person seated in the reclining chair.

It should be further obvious to one of ordinary skilled in the art that other mechanisms besides the link and guide could be utilized and that other springs, such as a compression spring, could be utilized to replace the leaf spring. Also, other mechanisms could be utilized to vary the force per unit distance moved during reclining than that described in FIG. 3.

It should be further apparent to one skilled in the art that numerous and other arrangements could be readily devised without departing from the spirit and scope of the invention.

We claim:

1. A reclining chair including a seat portion, a back portion and a base portion, said reclining chair comprising:

a first means for pivotally coupling a forward portion of said seat portion to said base portion such that said seat portion pivotally moves substantially about a first pivoting axis located adjacent said front portion;

a second means for coupling said seat and back portions together such that when said seat portion is pivoted about said first pivoting axis, said back portion simultaneously pivotally moves about a second pivoting axis located above said seat portion and adjacent said back portion, said second means comprising link means provided between said base and back portions; and a single spring means coupled to said base and supporting said seat portion for applying spring force to said first means, said spring means comprising a leaf spring, a swing arm coupled to said seat portion and a roller means coupled to said base and provided between and engaging with both said swing arm and said leaf spring;

whereby a reclining chair which is comfortable for both lightweight and heavyweight people is provided.

2. A reclining chair according to claim 1, wherein said single spring means further comprises a moving means coupled between said base portion and said roller means for moving said roller means longitudinally relative to said single portion spring means whereby a force per unit distance reclined may be varied.

3. A reclining chair according to claim 3 further comprising a means for varying a position of said roller to vary said spring force of said single spring means applied to said first means whereby a force per unit distance of recline as the chair is reclined may be varied.

4. A reclining chair according to claim 1 wherein said spring means further comprises a means for presetting a position of said roller means relative to said leaf spring and said swing arm.

* * * * *